US006189421B1

(12) United States Patent
Futo et al.

(10) Patent No.: US 6,189,421 B1
(45) Date of Patent: Feb. 20, 2001

(54) SLIP NUT WRENCH

(75) Inventors: Dennis M. Futo, Strongsville; Jeffrey S. Plantz, Seven Hills, both of OH (US)

(73) Assignee: Waxman Consumer Products Group, Inc., Bedford Heights, OH (US)

( * ) Notice: Under 35 U.S.C. 154(b), the term of this patent shall be extended for 314 days.

(21) Appl. No.: 08/753,174

(22) Filed: Nov. 20, 1996

(51) Int. Cl.[7] ..... B25B 13/52
(52) U.S. Cl. ..... 81/64; 81/3.44; 81/426.5
(58) Field of Search ..... 81/3.4, 3.44, 3.45, 81/64, 119, 121.1, 124.2, 426.5

(56) References Cited

U.S. PATENT DOCUMENTS

| | | | | |
|---|---|---|---|---|
| D. 33,732 | | 12/1900 | Howell . | |
| 213,698 | | 3/1879 | Sherwood et al. . | |
| D. 238,999 | | 3/1976 | Numbers . | |
| 276,064 | | 4/1883 | Morse . | |
| 1,410,415 | | 3/1922 | Shell . | |
| 1,422,308 | | 7/1922 | Schleicher . | |
| 1,976,623 | | 10/1934 | Monroe et al. . | |
| 1,994,415 | | 3/1935 | Edwards et al. . | |
| 2,082,699 | | 6/1937 | Keppinger . | |
| 2,607,248 | * | 8/1952 | Vlasak et al. | 81/3.44 |
| 2,990,213 | * | 6/1961 | Kolacinski | 81/3.44 X |
| 3,590,668 | | 7/1971 | Bristol . | |
| 4,058,031 | | 11/1977 | Magarian . | |
| 4,337,678 | | 7/1982 | Mumford . | |
| 4,504,087 | * | 3/1985 | Pennington | 81/64 X |
| 4,509,784 | * | 4/1985 | Vollers | 81/3.44 X |
| 4,749,251 | * | 6/1988 | Moulin | 81/124.2 X |
| 5,279,190 | * | 1/1994 | Goss et al. | 81/121.1 X |
| 5,440,957 | | 8/1995 | Rogers . | |
| 5,531,141 | * | 7/1996 | Gilbert | 81/426.5 |

* cited by examiner

*Primary Examiner*—James G. Smith
(74) *Attorney, Agent, or Firm*—Vickers, Daniels & Young

(57) ABSTRACT

A slip nut wrench comprises a C-shaped body portion having circumferentially spaced apart opposite ends from which handles extend laterally outwardly of the body portion to facilitate manual expansion and contraction thereof relative to a slip nut to be rotated thereby. The inner surface of the body portion includes a slip nut engaging arrangement for engaging slip nuts having a noded outer periphery.

15 Claims, 3 Drawing Sheets

SLIP NUT WRENCH

BACKGROUND OF THE INVENTION

This invention relates to the art of wrenches and, more particularly, to a wrench for tightening and loosening a slip nut relative to drain line components interconnected thereby.

It is of course well known that axially adjacent tube or pipe components in a drain line for a sink, such as a kitchen or bathroom sink for example, are interconnected by a sealing ring and slip nut to provide a sealed joint therebetween. The adjacent tubes may be telescopically interengaged for adjusting the axial position therebetween, and the axially outer end of the outer tube is provided with an annular sealing ring seat and is peripherally threaded to receive a slip nut. The slip nut is apertured to receive the inner tube adjacent the axially outer end of the outer tube and is internally threaded for threaded interengagement with the end of the outer tube to draw the slip nut against the sealing ring, thus to radially compress the sealing ring against the outer periphery of the inner tube. In another joint arrangement, the ends of the tubes are axially opposed and one of the tubes is provided with an end face and threads about the outer periphery thereof. The end of the other tube is provided with a radially outwardly extending peripheral flange, and the sealing ring is interposed between the flange and end face of the adjacent tubes. The slip nut axially engages against the flange, whereby the threaded interengagement between the slip nut and the one tube axially compresses the sealing ring between the flange and end face to seal the joint therebetween.

For many years, such pipe and slip nut components were of metal construction and the outer periphery of the slip nut was provided with a plurality of flat tool pads to facilitate the assembly and disassembly of a sealed joint through the use of an adjustable pipe wrench or the like. In more recent years, PVC, ABS and other plastic materials have been used in the construction of such drain tubes and slip nuts with the intention that the sealed joint between adjacent tubes be achieved through the hand tightening of the slip nut. Accordingly, the outer periphery of the slip nut is generally provided with circumferentially spaced apart axially extending ribs or nodes to facilitate grasping and turning the nut by hand. However, leaks often occur at the joints as the result of the inability to apply adequate torque to the slip nut by hand for achieving proper sealing interengagement between the pipes and sealing ring. Thus, while not recommended, and in fact often against specific instructions to the contrary, an adjustable pipe wrench is used to turn the slip nut. Often, adjustment of the wrench to achieve gripping of the nut thereby results in distorting the circular contour of the slip nut, sealing ring and the pipe components and, as a result of such distortion, rotation of the nut is more difficult and often results in over-tightening the nut. Moreover, such distortion subjects both the tube and nut to breakage and/or permanent distortion from the circular configuration thereof. All of these problems promote leakage at the joint which cannot be stopped, whereby the installation or repair operation has to begin anew. The teeth of a pipe wrench can also damage the outer surface of the slip nut and/or one of the pipes if a pipe wrench is also used to hold the latter pipe against rotation during the assembly and, in this respect, the teeth dig into the surface of the plastic components, thus marring the appearance thereof. Another factor which can result in such marring and/or distortion of the character referred to above is related to the axial contour of the slip nut. In this respect, the outer surface and nodes of slip nuts often have an axial portion thereof which tapers axially outwardly in the direction from the apertured end toward the internally threaded end thereof. Therefore, since the jaws of a pipe wrench are generally parallel and the teeth thereof straight, only an outer edge of opposed teeth of the wrench effectively engage the tapered outer surface or nodes of such a nut making it difficult to grip the nut for turning. For example, the jaws of the wrench tend to slide axially of the nut away from the threaded end thereof. If the jaws are manually forced toward the latter end and/or adjusted to increase the grip on the nut, both surface damage and distortion of the nut can result.

Further, as is well known, the slip nut joints associated with the J-shaped trap in a sink drain line are both horizontally and vertically close to one another, whereby it is difficult to engage and rotate the slip nuts through the use of a pipe wrench without engaging the trap or other pipes in the drain line with the wrench and thus potentially damaging and/or marring the surfaces thereof. Moreover, as is also well known, the space beneath kitchen and bathroom sinks is most often enclosed by a cabinet or vanity having a front access door, whereby a person installing and/or repairing or replacing a drain line has to reach into the cabinet from the front thereof to access the drain parts. This alone renders the manipulation of a heavy, adjustable pipe wrench difficult in connection with an installing or repairing operation, and such manipulation of the pipe wrench is most often made even more difficult by space limitations imposed by the side and rear walls of the enclosure. In this respect, the walls can both interfere with an limit positioning of the wrench for engagement with a slip nut and, thereafter, rotation of the nut. The closeness of the joint components to one another, together with such front access and space limitations, also make it difficult to grasp and rotate a slip nut by hand to the extent necessary to preclude leakage at the joint. Often, this is the reason for turning to a pipe wrench in an effort to stop leakage. Another potential problem exists in connection with disassembling a drain line which has been in place for a considerable period of time and in which one or more of the slip nuts at the joints therealong cannot be initially turned by hand in the direction to disassemble the joint, whereby a pipe wrench may once again be resorted to for the latter purpose.

As will be appreciated from the above, the installation and/or removal of a sink drain line of the character wherein the sealed joints include a slip nut which is intended to be manipulated by hand is physically difficult, time consuming and often frustrating to the person doing the work. Moreover, if the person resorts to the use of an adjustable, toothed pipe wrench or the like, the work can be more strenuous physically and can result in damage to the component parts at the joint such that sealing without leakage is not attainable, thus requiring new parts and restarting the installing, repairing and/or replacement operation. Even if use of a pipe wrench does not cause damage to the latter extent, the physical effort is still required and the surfaces of the component parts at or adjacent to joint can be marred so as to detract from the otherwise pleasing appearance thereof.

SUMMARY OF THE INVENTION

In accordance with the present invention, a slip nut wrench is provided which advantageously enables rotation of a plastic slip nut to achieve assembly or disassembly of a sealed joint in a drain line in a manner which promotes obtaining a good seal during assembly as well as both assembly and disassembly without distorting the circular contour of the nut and/or physically damaging or marring the outer surface thereof. Further, the wrench is of a size and construction which facilitates interengagement with a slip nut under conditions of limited working space and which, under such conditions, optimizes the degree of rotation which can be imparted to a slip nut without having to circumferentially reposition the wrench relative to the nut. Moreover, the structure of the wrench facilitates the turning of slip nuts in which the outer surface and nodes are either axially straight or tapered and advantageously minimizes the time and effort required to reposition the wrench between sequential rotating displacements of the nut.

Preferably, the wrench is constructed of a suitable durable and flexible plastic material, for example a polypropylene material such as a polypropylene copolymer, and comprises a C-shaped body portion having circumferentially spaced apart ends and a handle arrangement by which the body portion is manipulated for a slip nut to be axially received therein and rotated about the axis thereof. The inner side of the body portion extends circumferentially about the outer surface of the slip nut and is adapted to interengage with the nodes thereon in either direction of rotation, thus to achieve both assembly and disassembly of a sealed joint in a drain line. Preferably, the handle arrangement includes a handle extending outwardly from each of the opposite ends of the body portion, thus providing a pair of handles which can be grasped in a person's hand and pulled together so as to constrict the body portion relative to the slip nut so as to optimize the driving interengagement of the wrench with the nut while providing the user with a feel for the tightness of the nut during a joint assembling operation. Further in accordance with the invention, the lateral dimension of the handle arrangement relative to the body portion corresponds to the width of a hand and, thus, is relatively short in comparison with the length of the handle of a pipe wrench. This advantageously enables the user to apply a higher torque to the nut than is possible by hand rotation of the nut, thus to optimize obtaining aproperly sealed joint while minimizing the likelihood of over-tightening the nut. The short handle also facilitates manipulating the wrench relative to the joint components under conditions of limited working space and optimizes the extent to which a nut can be rotated without having to reposition the wrench relative thereto. Still further, the C-shaped configuration of the body portion of the wrench provides for interengagement thereof with a slip nut in a manner which precludes distorting the circular configuration of the nut and physically damaging the nut and tube as a result of such distortion, and the slip nut engaging inner surface of the wrench advantageously provides for rotational displacement of the nut to be achieved without marring or otherwise physically damaging the outer surface of the nut, thus optimizing retention of the appearance thereof.

It is accordingly an outstanding object of the present invention to provide a slip nut wrench for rotating a plastic slip nut in conjunction with assembling or disassembling a joint between tubular pipe components in a drain line.

Another object is the provision of a slip nut wrench of the foregoing character by which a slip nut can be rotated without diametrical distortion thereof or diametrical distortion of the tube component onto or from which the nut is being rotated.

A further object is the provision of a slip nut wrench of the foregoing character which enables application of torque to a slip nut during assembly of a sealed joint in a manner which promotes obtaining a sealed joint without leakage.

Still another object is the provision of a slip nut wrench of the foregoing character which enables the rotation of a slip nut to achieve assembly or disassembly of a sealed drain line joint without imparting physical damage to the slip nut.

Another object is the provision of a slip nut wrench of the foregoing character which optimizes the degree of rotation which can be imparted to a slip nut in a confined space without having to circumferentially reposition the wrench relative to the nut.

Yet a further object is the provision of a slip nut wrench of the foregoing character wherein circumferential repositioning of the wrench between sequential rotational displacements of the nut is easily and quickly achieved.

Another object is the provision of a slip nut wrench of the foregoing character by which the time and physical effort required to assemble or disassemble a sealed joint in a drain line is minimized.

Yet a further object is the provision of a slip nut wrench of the foregoing character which is economical to manufacture, easy to manipulate with respect to engagement and disengagement thereof with a slip nut and rotation of a slip nut thereby, and which is efficient in connection with rotating a slip nut with minimum physical effort on the part of the user.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
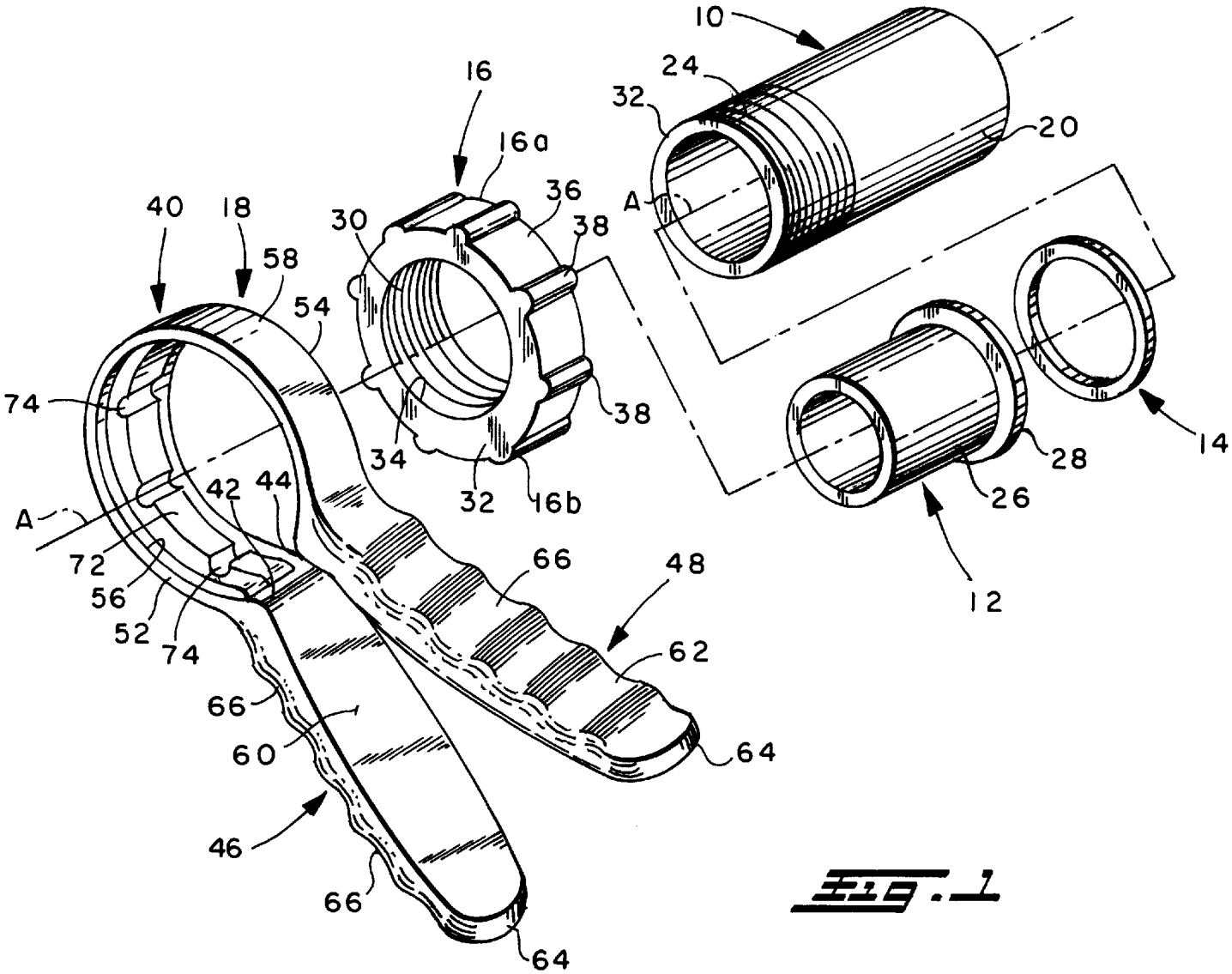
FIG. 1 is an exploded perspective view of drain line components including a slip nut, and a slip nut wrench in accordance with the invention.

Referring now in greater detail to the drawings wherein the showings are for the purpose of illustrating preferred embodiments of the invention only, and not for the purpose of limiting the invention, FIG. 1 illustrates tubular drain line components 10 and 12 to be coaxially joined together with a sealing ring 14 therebetween by means of a slip nut 16 and through the use of a slip nut wrench 18 to be described in detail hereinafter. Components 10 and 12 are shown as straight tubes for purposes of illustration only, and it will be appreciated that the ends of the components to be joined together can be associated with curved tubes such as that defined by a J-shaped trap and a trap extension, or other drain line components including, for example, tail pipe extensions, elbows, tees and straight couplings. Tube 10 is shown as a plastic tube 20 having an axis A, an axially outer end face 22 and external threads 24 extending about the periphery thereof and axially inwardly from end face 22. Component 12 is shown as a plastic tube 26 having a radially outwardly extending peripheral end flange 28 at one end thereof coaxial with and axially opposed to end face 22 of component 10. Sealing ring 14 is of a suitable rubber or plastic material and is interposed between end face 22 and flange 28 so as to be axially compressed therebetween when the joint is assembled. Slip nut 16 is of a suitable plastic material such as PVC or ABS and is provided at the axially inner end l6*a* thereof with internal threads 30 for threaded interengagement with threads 24 on the end of component 10. The axially outer end 16*b* of slip nut 16 includes a flange 32 which extends radially inwardly relative to internal threads 30 and provides a circular opening 34 coaxial with axis A and through which tube 26 of component 12 extends when the joint is assembled. When slip nut 16 is threaded onto the end of component 10, the inner side of flange 32 engages against the axially outer side of flange 28 whereby, upon tightening slip nut 16, sealing ring 14 is axially compressed between flange 28 and end face 22.

In the embodiment illustrated, outer surface 36 of slip nut 16 is of a diameter of about two inches and is provided with eight nodes 38 which are circumferentially spaced apart about the periphery thereof and extend axially between the inner and outer ends of the nut. Nodes 38 are generally semi-circular in cross section transverse to axis A providing first and second node surfaces 38*a* and 38*b* on circumferentially opposite sides of a corresponding radial plane through axis A and circumferentially bisecting the node. Accordingly, it will be appreciated that node surfaces 38*a* face in the same direction circumferentially and that node surfaces 38*b* face in the same circumferential direction relative to one another and which direction is opposite to that of surfaces 38*a*. Nodes 38 have a circumferential dimension of about five thirty-seconds of an inch and protrude radially outwardly from surface 36 about three thirty-seconds of an inch to facilitate rotating the slip nut by hand. When the component parts have been coaxially aligned and assembled by rotating slip nut 36 onto threads 24 of component 10 as described above, slip nut wrench 18 is operable in the manner set forth hereinafter to tighten the slip nut relative to component 10 to complete the joint assembly.

Figure 2:
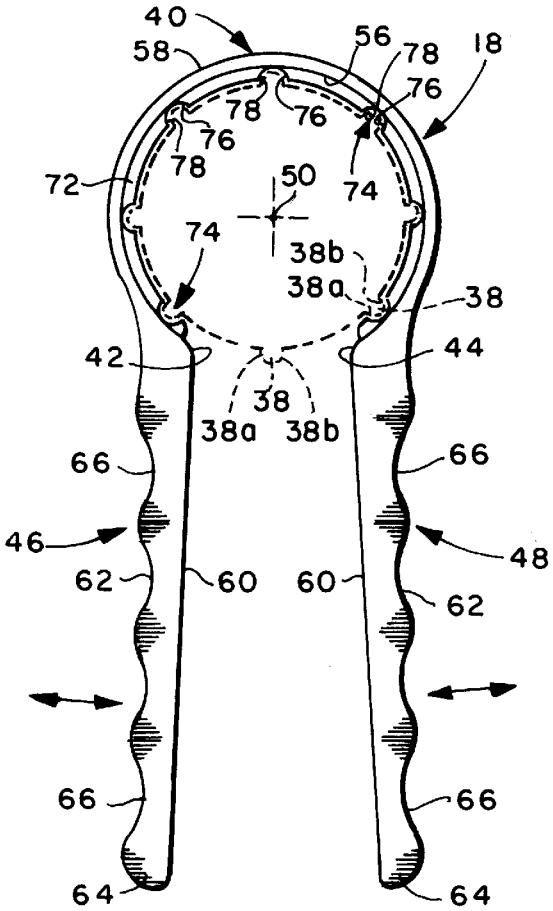
FIG. 2 is an end elevation view of the wrench illustrated in FIG. 1.
Figure 3:
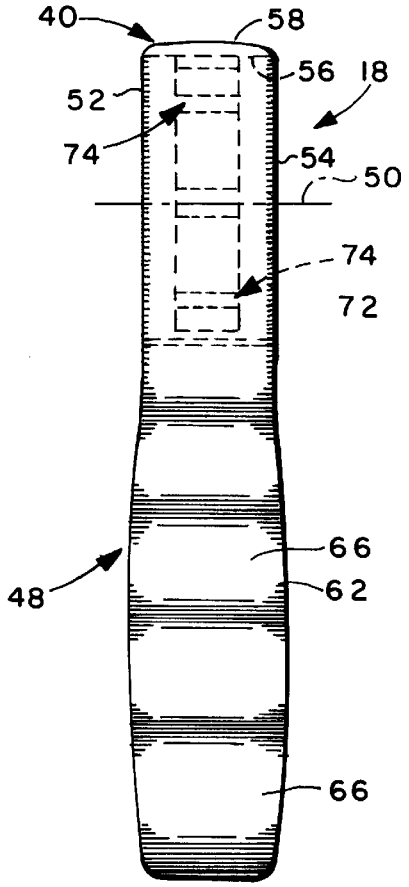
FIG. 3 is a side elevation view of the wrench looking in the direction from right to left in FIG. 2, the opposite side elevation view being identical.

Referring now to FIGS. 1–3 of the drawing, slip nut wrench 18 comprises a circular, C-shaped body portion 40 having circumferentially opposite ends 42 and 44 and handles 46 and 48 extending outwardly from ends 42 and 44, respectively. Body portion 40 has an axis 50 and, preferably, the wrench is of one-piece construction and is made of a resilient polymeric material such as that referred to hereinabove and which, in the manner and for the purposes set forth more fully hereinafter, provides for body portion 40 to be circumferentially expandable and contractible relative to the condition thereof shown in FIG. 2. Body portion 40 has axially opposite sides 52 and 54 and, has an axial length generally corresponding to the axial length of slip nut 16. Body portion 40 further includes a circular inner surface 56 and a circular outer surface 58. Handles 46 and 48 have circumferentially opposed inner sides 60, outer sides 62 and laterally outer ends 64 and, preferably, outer sides 62 are undulated to provide arcuate recesses 66 for receiving the fingers of a user. As best seen in FIG. 2, outer surface 58 of body portion 40 and outer surfaces 62 of handles 46 and 48 are at an angle to one another at the juncture therebetween at ends 42 and 44 of the body portion. Each of the handles has a thickness between surfaces 60 and 62 at the juncture which is greater than the radial dimension between inner and outer surfaces 56 and 58 of body portion 40 and this provides rigidity between the handles and body portion to preclude flexure therebetween and thus maintain the angle therebetween.

The interior of body portion 40 includes a slip nut engaging arrangement adapted to engage with the outer periphery of a slip nut so that the latter can be rotated by the wrench. In the embodiment illustrated in FIGS. 1–3, the slip nut engaging arrangement is defined by a radially inwardly projecting recessed rib 72 on inner surface 56 of body portion 40 which extends circumferentially thereof between opposite ends 42 and 44. Rib 72 is preferably integral with body portion 40 and is provided with a plurality of radially inwardly open U-shaped recesses 74 in circumferentially spaced apart node engaging areas along the rib so as to receive nodes 38 of slip nuit 16 as shown in FIG. 2. Each node engaging area circumferentially intersects the radial plane through the nut axis bisecting the corresponding node, and each of the recesses 74 includes circumferentially opposed first and second slip nut engaging surfaces 76 and 78, respectively. Accordingly, it will be appreciated that surfaces 76 of circumferentially adjacent ones of the recesses 74 face in the same direction circumferentially of the wrench while surfaces 78 thereof face in the same direction relative to one another but opposite to the direction of surfaces 76. Thus, for example, in rotating wrench 18 clockwise in FIG. 2, surfaces 78 engage node surfaces 38*b* to rotate slip nut 16 clockwise and, in response to rotating wrench 18 counterclockwise in the same figure, surfaces 76 engage node surfaces 38*a* to rotate the nut counterclockwise. While it is preferred to provide for the number of recesses 74 to correspond to the number of nodes within the body portion between ends 42 and 44 thereof, it will be appreciated that rotation of nut 16 can be achieved with just one such recess. In connection with such a modification, the portion of rib 72 other than that required to provide the one recess could be eliminated, whereby inner surface 56 of body portion 40 would engage with the radially outer ends of nodes 38 to support body portion 40 coaxial with the slip nut. While it is further preferred to provide for recesses 74 to closely conform in contour with that of nodes 38 so as to minimize relative circumferential displacement between the wrench and a slip nut, it will be appreciated that the recesses can have a circumferential dimension which provides for surfaces 76 and 78 thereof to be circumferentially spaced apart so as to provide such relative displacement. As best seen in FIG. 3, rib 72 has an axial width less than the axial length of body portion 40 as defined by opposite sides 52 and 54 thereof, and the rib dimension in this respect advantageously promotes engagement with the axially straight portion of a slip nut having an axial portion of the nodes thereon tapering outwardly relative to the nut axis. However, it will be appreciated that the recessed rib could be axially coextensive with body portion 40, or axially narrower than shown, while still retaining the slip nut engaging capability.

In FIG. 2, wrench 18 is shown in a neutral condition in which opposite ends 22 and 24 of body portion 40 are spaced apart a given distance. The plastic material of which the wrench is made provides for body portion 40 to have a resiliency which enables ends 42 and 44 to be displaced away from one another to provide a circumferentially expanded condition of the body portion in which ends 42 and 44 are spaced apart a distance greater than the given distance. Likewise, the resiliency of the material enables ends 42 and 44 to be circumferentially displaced toward one another to provide a contracted or constricted condition of the body portion in which ends 42 and 44 are spaced apart a distance less than the given distance. Such displacement of body portion 40 from the neutral condition to either the expanded or contracted condition is achieved through the manipulation of handles 46 and 48 as discussed more fully hereinafter, and the resiliency of the plastic material provides for body portion 40 to return to the neutral condition upon being released from the expanded or contracted condition thereof. As is well known, the standard diametrical dimensions for drain tubes are 1¼" and 1½" and, in connection with joining tubes of either size, the outside diameter of the slip nut may either be the same for both tube sizes or may be smaller for the smaller tube size. Accordingly, it will be appreciated that body portion 40 of wrench 18 can be sized to axially slidably receive a slip nut 16 of given diameter with body portion 40 of the wrench in its neutral condition, as shown in FIG. 2. Assuming the component parts of the drain line shown in FIG. 1 to have been assembled as described hereinabove to the extent that slip nut 16 is hand tight and tube portion 26 extends axially outwardly through opening 34 in the nut, handles 46 and 48 of wrench 18 are displaced away from one another to the extent necessary to enable the handles to move across tube 26 for the latter to enter body portion 40. The wrench is then axially displaced toward slip nut 16 for nodes 38 of the latter to be axially received in recesses 74 in body portion 40. Handles 46 and 48 are then displaced toward one another to constrict body portion 40 and thus recesses 74 into tight engagement with the slip nut to facilitate rotation thereof. When the nut has been rotated to the extent permitted, such as by an obstruction in the path of rotation, handles 46 and 48 are released, whereby body portion 40 returns to its neutral condition. The wrench is then axially removed from the nut, rotated back to its initial position and axially moved back into engagement with the nut for imparting further rotation thereto.

While the above-described interengaging relationship between the slip nut and the nut engaging portion of wrench 18 in the neutral condition of the body portion is preferred, it will be appreciated that the neutral condition of body portion 40 relative to nut 16 could be such that handles 46 and 48 would have to be displaced away from one another to displace body portion 40 to an expanded condition for axially receiving nut 16 therein. Likewise, it will be appreciated that the slip nut may be of a smaller diameter than that which provides the preferred interengaging relationship whereby, when the nut is axially received in body portion 40, handles 46 and 48 have to be displaced toward one another to displace body portion 40 from the neutral to a more constricted condition than that described above for the nut engaging portion to firmly engage with the nut for rotating the latter.

Figure 4:
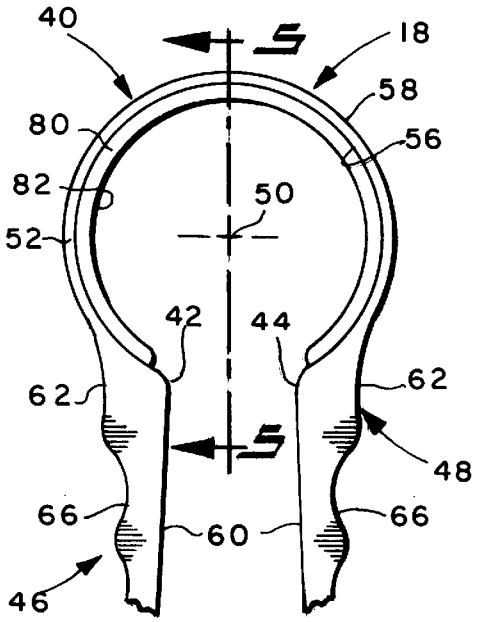
FIG. 4 is an end elevation view of the body portion of another embodiment of a slip nut wrench in accordance with the invention.
Figure 5:
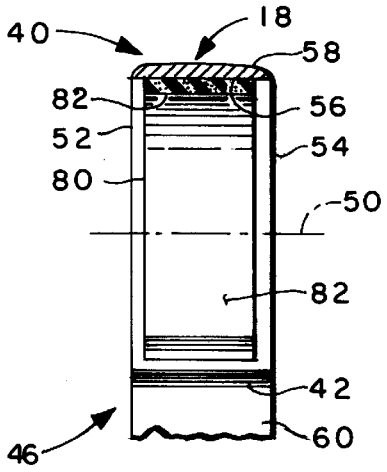
FIG. 5 is a sectional elevation view taken along line 5—5 in FIG. 4.
Figure 6:
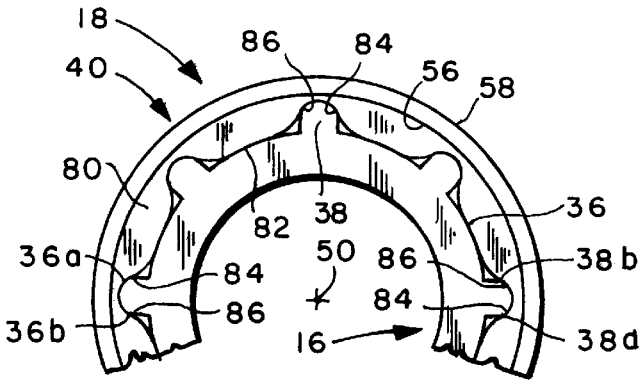
FIG. 6 is an enlarged end elevation view of a portion of the body portion illustrated in FIG. 4 and showing a slip nut engaged therein.

FIGS. 4–6 of the drawing illustrate a modification of the slip nut engaging arrangement on the inner side of body portion 40 of wrench 18. The wrench is otherwise the same as illustrated and described hereinabove in connection with FIGS. 1–3, whereby like numerals appear in FIGS. 4–6 to designate corresponding parts of the wrench. In the embodiment of FIGS. 4–6, inner surface 56 of body portion 40 is provided with a pad 80 of radially outwardly compressible resilient rubber or plastic material. Preferably, pad 80 has a durometer hardness of 75, and the pad can be fabricated, for example, from a PVC material available from Advanced Elastomer Systems of Akron, Ohio, under the trade name Vyram. Pad 80 extends along surface 56 between ends 42 and 44 of the body portion and is substantially axially coextensive therewith. Pad 80 has a smooth inner surface 82 and is of uniform radial thickness along its length and between the axially opposite sides thereof. Body portion 40 is adapted to receive a slip nut therein either in the neutral condition of the body portion or in an expanded condition thereof. As will be appreciated from FIG. 6, when the body portion is constricted from the neutral condition by the manipulation of handles 46 and 48, or returns to the neutral condition from the expanded condition, nodes 38 of slip nut 16 become embedded in corresponding node engaging areas of the pad material to facilitate rotation of the nut. In particular in this respect, pad 80 has a radial thickness whereby compression of the pad provides pad surfaces 84 and 86 on circumferentially opposite sides of each node 38 for respectively drivingly engaging node surfaces 38*a* and 38*b* in the manner described hereinabove with regard to recess surfaces 76 and 78 in the embodiment of FIGS. 1–3. Advantageously in accordance with this embodiment, the resilience and compressibility of pad 80 provides for the node engaging areas to be circumferentially variable in location along the length of the pad, whereby extremely short angular turning strokes of the wrench can be made to facilitate rotating the slip nut in restricted space situations.

Figure 7:
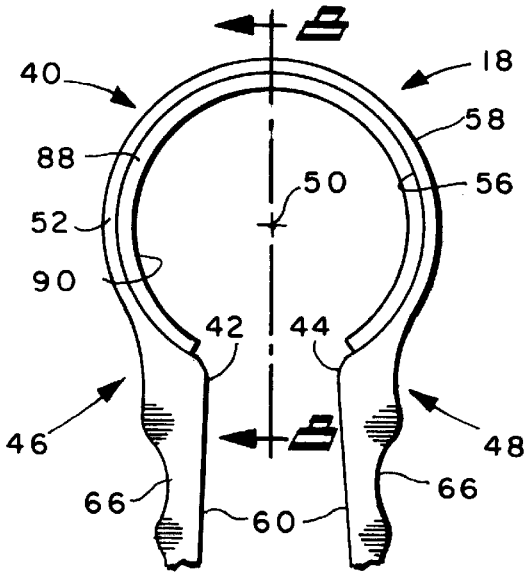
FIG. 7 is an end elevation view of the body portion of yet another embodiment of a slip nut wrench in accordance with the invention.
Figure 8:
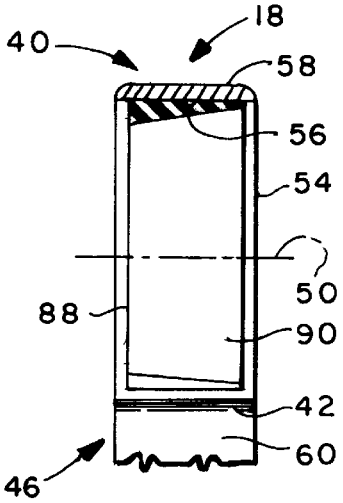
FIG. 8 is a sectional elevation view taken along line 8—8 in FIG. 7.

FIGS. 7 and 8 of the drawing illustrate another embodiment of a nut engaging arrangement for wrench 18 which, otherwise, is of the same structure described hereinabove, whereby component parts of the wrench are designated by the same numerals appearing in FIGS. 1–3. In this embodiment, inner surface 56 of body portion 40 of wrench 18 is provided with a slip nut engaging pad 88 of a radially compressible resilient rubber or plastic material which can be the material referred to hereinabove in connection with pad 80. Pad 88 extends circumferentially between ends 42 and 44 of the body portion and is substantially axially coextensive with body portion 40 as defined by axially opposite sides 52 and 54 thereof. Pad 88 axially tapers in radial thickness and in the embodiment illustrated has an inner surface 90 which tapers radially outwardly relative to axis 50 in the direction from side 52 of the body portion toward side 54 thereof. This advantageously provides for the wrench to be operable with slip nuts having different outside diameters, and/or slip nut in which a portion of the outer surface and nodes taper in the direction between the axially opposite ends thereof. As in the embodiment described above in connection with FIGS. 4–6, pad 88 provides node engaging areas circumferentially therealong, and the pad is radially compressible for the nodes to be embedded therein to provide node engaging surfaces corresponding to surfaces 84 and 86 in pad 80.

Figure 9:
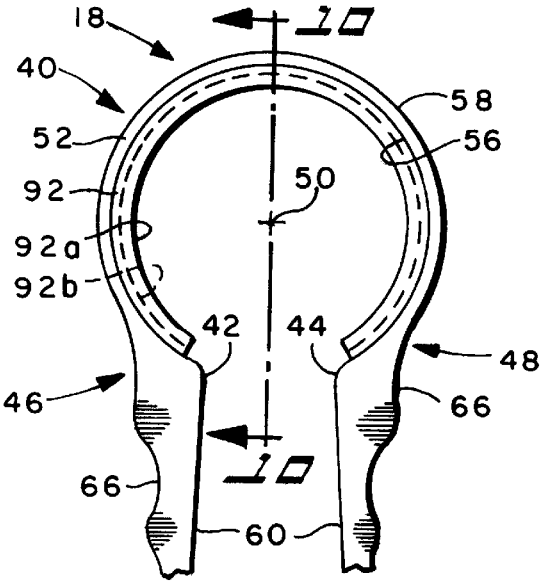
FIG. 9 is an end elevation view of the body portion of another embodiment of a slip nut wrench according to the invention.
Figure 10:
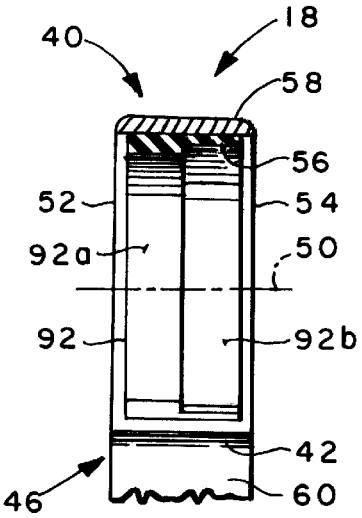
FIG. 10 is a sectional elevation view taken along line 10—10 in FIG. 9.

FIGS. 9 and 10 illustrate yet another embodiment of the slip nut engaging arrangement for wrench 18 and wherein wrench 18 is otherwise of the same structure as in the earlier embodiments whereby the component parts thereof are designated by like numerals. In FIGS. 9 and 10, inner surface 56 of body portion 40 of the wrench is provided with a slip nut engaging pad 92 of a radially compressible resilient material such as that referred to herein with regard to pads 80 and 88. Pad 92 extends circumferentially between ends 42 and 44 of body portion 40 and is substantially axially coextensive with the body portion as defined by sides 52 and 54 thereof and, in this embodiment, pad 92 includes axially adjacent first and second pad portions 92*a* and 92*b* having different radial thicknesses relative to axis 50. More particularly in this respect, pad 92 is radially stepped about midway between the axially opposite sides thereof to provide for pad portion 92*a* to have a radial thickness greater than that of pad portion 92*b*. The stepped contour advantageously provides for the pad to drivingly interengage with slip nuts having different outside diameters and/or with slip nuts in which a portion of the outer surface and nodes taper in the direction between the opposite ends of the nut. As in the embodiments described hereinabove in connection with FIGS. 4–8, pad 92 provides node engaging areas circumferentially therealong, and the pad is radially compressible for the nodes on a slip nut to be embedded therein to provide circumferentially opposed node engaging surfaces in each node engaging area. It will be appreciated that pad portions 92*a* and 92*b* can be defined by separate strips of resilient material as opposed to the one-piece construction shown in FIG. 10.

In each of the embodiments described above in connection with FIGS. 4–10 the pad is suitably secured to inner surface 56 of the body portion of the wrench such as by adhesive bonding. With regard to the embodiment shown in FIGS. 1–3, it will be appreciated that a rib providing recesses corresponding to recesses 74 could be formed as a separate component and secured to inner surface 56 such as by adhesive bonding. In connection with such a modification, the rib could be formed of the same or a different plastic material then the body portion and handles, or of a rubber material.

While considerable emphasis has been placed on the preferred embodiments of the invention illustrated and described herein, it will be appreciated that other embodiments can be made and that many changes can be made in the preferred embodiments without departing from the principals of the invention. Accordingly, it is to be distinctly understood that the foregoing descriptive matter is to be interpreted merely as illustrative of the invention and not as a limitation.

Having thus described the invention, it is claimed:

1. A wrench for rotating a plastic slip nut relative to axially opposed tubular drain line components having a diameter greater than one inch and coupled by said slip nut to provide a joint therebetween, said nut having a nut axis, a circular outer surface and a plurality of circumferentially spaced apart axially extending nodes projecting radially outwardly of said outer surface, said wrench comprising a C-shaped body portion of resilient polymeric material having a wrench axis, circumferentially spaced apart first and second ends and an inner surface between said ends, slip nut engaging means fixed on said inner surface and providing circumferentially opposed radially inwardly extending first and second node engaging surfaces, whereby a node on a slip nut coaxially received in said body portion is circumferentially between said first and second node engaging surfaces, first and second handles respectively on said first and second ends and extending from said body portion for rotating said body portion in opposite directions about said wrench axis for said first and second node engaging surfaces to alternately drivingly engage with circumferentially opposite sides of said node for rotating said nut in opposite directions about said nut axis, said handles having opposed spaced apart inner surfaces, said body portion having a neutral condition in which said ends of said body portion and said inner surfaces of said handles are spaced apart a given distance, the resiliency of said polymeric material biasing said body portion to said neutral condition, said given distance and the resiliency of said polymeric material providing for said handles to receive one of said drain line components therebetween and for said handles and body portion to be moved laterally onto said one drain line component for aligning said wrench axis with said nut axis.

2. A wrench according to claim 1, wherein said body portion has a second condition in which said ends are spaced apart a second distance different from said given distance, and said handles being displaceable relative to one another for displacing said body portion from said neutral condition to said second condition.

3. A wrench according to claim 2 wherein said body portion and said handles are integrally joined and said handles are constructed of said polymeric material.

4. A wrench according to claim 1, wherein said body portion and said handles are integrally joined and said handles are constructed of said polymeric material, said body portion having a circumferentially extending outer surface, said inner and outer surfaces of said body portion providing said body portion with a radial thickness, and each said handle having an outer surface, said inner and outer surfaces of said first and second handles extending at an angle to the inner and outer surfaces of said body portion respectively at the first and second ends of said body portion, said inner and outer surfaces of each handle providing a handle thickness respectively at said first and second ends greater than said radial thickness for maintaining the angle between said inner and outer surfaces of said body portion and said handles.

5. A wrench according to claim 4, wherein each said first and second handle has an outer end spaced from the corresponding one of said first and second ends of said body portion, said outer surface of each said handle including an undulated outer surface portion between said corresponding one of said ends and said outer end thereof.

6. A wrench according to claim 1, wherein said first and second node engaging surfaces include a plurality of radially inwardly open recesses circumferentially spaced apart between said ends.

7. A wrench according to claim 6 wherein said recesses are U-shaped transverse to said wrench axis.

8. A wrench according to claim 1, wherein said first and second node engaging surfaces include a radially inwardly projecting rib on said inner surface of said body portion between said ends, and a plurality of circumferentially spaced apart radially inwardly open U-shaped recesses in said rib.

9. A wrench according to claim 8 wherein said recesses are generally semi-circular transverse to said wrench axis.

10. A wrench for rotating a plastic slip nut relative to axially opposed tubular drain line components having a diameter greater than one inch and coupled by said slip nut to provide a joint therebetween, said nut having a nut axis, a circular outer surface and a plurality of circumferentially spaced apart axially extending nodes projecting radially outwardly of said outer surface, each said node having arcuate node surfaces on circumferentially opposite sides of a radial plane through said nut axis bisecting the corresponding node, said wrench comprising a C-shaped body portion of resilient polymeric material having a wrench axis, circumferentially spaced apart first and second ends, an inner surface between said ends and first and second handles respectively extending outwardly from said first and second ends, node engaging pad means of resilient material on said inner surface between said ends, said pad means being radially outwardly compressible relative to said inner surface, said body portion having a first condition for receiving a slip nut therein coaxial with said wrench axis, said handles being displaceable toward one another for displacing said body portion from said first condition to a constricted condition in which each node of said nut radially outwardly compresses said pad means to produce a radially inwardly open arcuate recess having circumferentially opposite sides facially engaging the arcuate node surfaces on the circumferentially opposite sides of the node, said handles having opposed spaced apart inner surfaces, said body portion having a neutral condition in which said ends of said body portion and said inner surfaces of said handles are spaced apart a given distance, the resiliency of said polymeric material biasing said body portion to said neutral condition, said given distance and the resiliency of said polymeric material providing for said handles to receive one of said drain line components therebetween and for said handles and body portion to be moved laterally onto said one drain line component for aligning said wrench axis with said nut axis.

11. A wrench according to claim 10, wherein said body portion has axially opposite sides, said pad means extending circumferentially between said ends and axially between said sides and including axially adjacent first and second pad portions radially stepped relative to said wrench axis.

12. A wrench according to claim 10, wherein said body portion has axially opposite sides, said pad means extending circumferentially between said ends and axially between said sides and being of uniform radial thickness relative to said wrench axis.

13. A wrench according to claim 10, wherein said body portion has axially opposite sides, said pad means extending circumferentially between said ends and axially between said sides and having a radially inner surface inclined relative to said wrench axis in the direction between said sides.

14. A wrench according to claim 10, wherein said body portion and said handles are integrally joined and said handles are constructed of said polymeric material, said body portion having a circumferentially extending outer surface, said inner and outer surfaces of said body portion providing said body portion with a radial thickness, and each said handle having an outer surface, said inner and outer surfaces of said first and second handles extending at an angle to the inner and outer surfaces of said body portion respectively at the first and second ends of said body portion, said inner and outer surfaces of each handle providing a handle thickness respectively at said first and second ends greater than said radial thickness for maintaining the angle between said inner and outer surfaces of said body portion and said handles.

15. A wrench according to claim 14, wherein each said first and second handle has an outer end spaced from the corresponding one of said first and second ends of said body portion, said outer surface of each said handle including an undulated outer surface portion between said corresponding one of said ends and said outer end thereof.

* * * * *